United States Patent [19]

Brewer et al.

[11] Patent Number: 5,000,650

[45] Date of Patent: Mar. 19, 1991

[54] AUTOMATIC RETURN TO TRAVEL

[75] Inventors: Lloyd A. Brewer; James C. Skeel, both of Wausau; William R. Seidel, Racine, all of Wis.

[73] Assignee: J.I. Case Company, Racine, Wis.

[21] Appl. No.: 350,804

[22] Filed: May 12, 1989

[51] Int. Cl.[5] ..... E02F 3/28

[52] U.S. Cl. ..... 414/699; 37/DIG. 1; 172/812

[58] Field of Search ..... 414/697, 698, 699; 172/812; 37/DIG. 1, DIG. 15, 118 R, 118 A

[56] References Cited

U.S. PATENT DOCUMENTS 3,819,061 6/1974 Andersson et al. ..... 901/13 X

FOREIGN PATENT DOCUMENTS 0184131 9/1985 Japan ..... 37/DIG. 1

0989004 1/1983 U.S.S.R. ..... 37/DIG. 15

*Primary Examiner*—Robert J. Spar

*Assistant Examiner*—Donald W. Underwood

[57] ABSTRACT

The material loading machine supported on the ground surface is in combination with a return to travel assembly. The combination includes a material loading machine chassis, a work implement, and at least one lift arm supported by the chassis to pivot between an uppermost position and a lower most position while supporting the work implement. Actuators pivotally raise and lower the lift arm. A lift arm position control system automatically stops the lift arm in an uppermost position when it is raised upwardly and automatically stops the lift arm in a return to travel position when it is lowered. In the return to travel position the work implement is located safely above the ground surface so that the vehicle may travel without scraping the work implement on the ground surface.

10 Claims, 2 Drawing Sheets

Fig-5
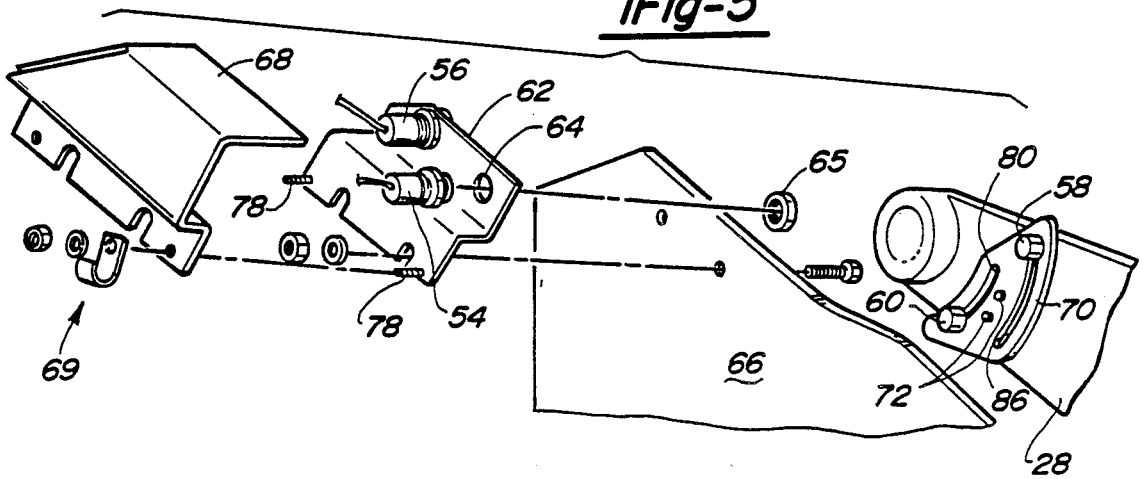
Fig-6
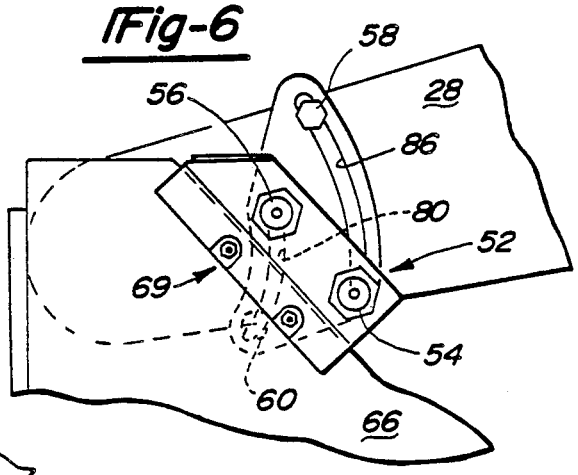
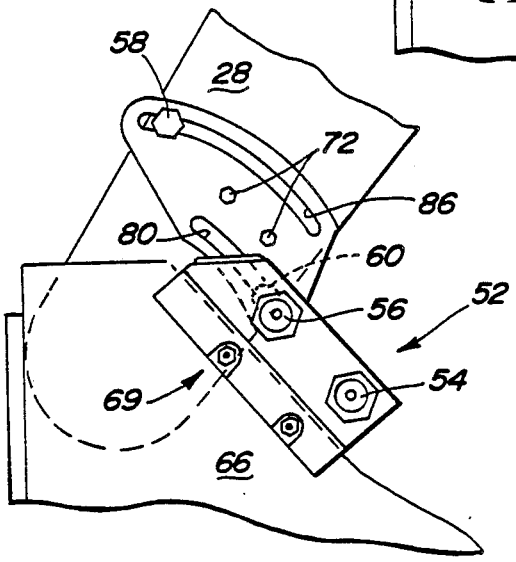
Fig-7
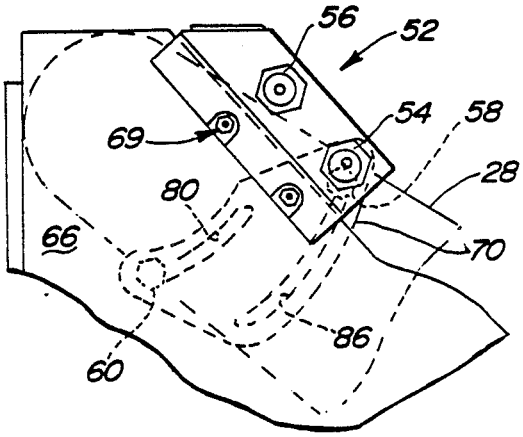
Fig-8

AUTOMATIC RETURN TO TRAVEL

FIELD OF THE INVENTION

The present invention relates to systems for raising the lift arm or arms, which carry a work implement, of a tractor digging and loading machine to a predetermined position to bring the implement to a preselected maximum height above the ground and lowering the lift arm or arms to a predetermined position to bring the implement to a preselected minimum height above the ground. More particularly, the present invention relates to a system for controlling the height of the implement above ground so that the lift arm may be automatically lowered to a predetermined position to bring the implement to a height above the ground for traveling to, from, and about a worksite.

BACKGROUND OF THE INVENTION

Conventional digging and lifting machines, such as a tractor digging and loading machine having a digging bucket mounted on lift arms, are provided with a multiplicity of complex controls for operating the lift arms and the tilt of the digging bucket. Operators of these sophisticated machines must concentrate on the controls for lifting, lowering and tilting the bucket during digging and loading operations, while at the same time concentrate on such operations as steering, braking, and controlling the speed of the tractor vehicle. Much effort has been made by those skilled in this technology to decrease the complexity of operating a tractor digger/-loader by making certain operations involving the orientation of the bucket and its height above ground to be controlled automatically. Some of those attempts have particularly concentrated on remedying the problem faced by the operator of most conventional tractor digger/loaders of not being able to visually observe the bucket height above ground to assure that it is in its correct operating position while locating the overall position of the tractor.

RELATED ART

One such effort yielded the invention of U.S. Pat. No. 3,211,310, issued to McIndoo. McIndoo's invention is a trip mechanism that is adapted to automatically position the tractor's bucket in one or more operating positions. This invention employs a master-slave system which is arranged to be tripped to inactivate the hydraulic control circuit for the lift arms in response to engagement of one or more uniquely positioned cams. The cams are arranged to provide an arc pursuant to a raising or lowering of the lift arms. Once the control system is deactivated, the lift arms and thus the bucket are maintained in a predetermined operating position.

In U.S. Pat. No. 3,289,546, issued to Erickson, a control is employed to control the flow of actuating pressure fluid to a hydraulic motor, such as a linear actuator, in order to interrupt the operation of the motor at a desired time. Thus, a motor that is used to position the lift arms on a tractor may be interrupted in operation to position the lift arms at any particular location. The invention is an improvement over prior controls of this type by providing a hydraulic circuit that includes a cyclically operable valve effective to vent the hydraulic circuit to the atmosphere to keep it free of entrapped air. The invention employs the working pressure fluid to achieve the same results of prior controls of this type.

U.S. Pat. No. 3,626,428, issued to Lark et al. teaches use of an electrical control circuit for automatically raising the lift arms and another electrical control circuit for automatically and continuously orienting the bucket in a predetermined relationship with the lift arms. A third electrical circuit is used for automatically rotating the bucket from a first position to a second position. Other electrical circuits are employed for automatically lowering the lift arm and automatically orienting the bucket in a preselected angular relationship with the ground and to enable the lift arm and the bucket to follow the surface of the ground. Activation of all these electrical circuits may be enabled in a preselected sequence by closing a switch which is located within easy access of the operator. A manual override control is available so that the lift arms and bucket may be operated in a conventional manner.

U.S. Pat. No. 3,915,325, also issued to Lark et al., discloses an electronically controlled return to dig assembly. After initial indexing, this invention automatically positions the bucket on the tractor by comparing current in different circuits, and upon detection of a current imbalance, hydraulic means are employed to achieve a zero imbalance corresponding the initial indexing position.

U.S. Pat. No. 4,011,959, issued to Papasideris, teaches mounting two proximity switches on the outer cylinder wall of the hydraulic actuator for tilting the bucket of the tractor. A magnet for affecting the proximity switches is mounted on the piston rod of the hydraulic actuator. The mechanism is used to maintain a desired orientation of the bucket during loading operations.

Although the controls disclosed by the related art have been largely successful in providing automatic positioning means for the lift arms and bucket of the tractor, the systems are relatively complex when compared to the present invention. Moreover, the present invention is the result of yet another reduction in the overall work concentration by the operator, that is, the present invention employs means adaptive to automatically lower the lift arms to a predetermined position whereat the lift arms hold the bucket at a travel height above the ground where it is available to quickly return to a dig position, without employing the concentration of the operator who is free to drive the tractor to, from, and about a worksite.

OBJECTS OF THE INVENTION

Accordingly, it is the primary object of the present invention to provide a system for returning the bucket to a position at which it is safely above the ground for traveling from one worksite to another, and yet in a position from which it may be quickly engaged into work posture for digging, without the operator having to manually control the return to travel position.

It is another object of this invention to provide a new and improved control device for positioning the lift arms and bucket of a tractor.

Yet another object of the present invention is to provide a simple and efficient targeting mechanism to position the lift arms and bucket of a tractor loader.

It is yet still another object of the present invention to provide a new and improved control device that will target the lift arms and bucket of a tractor loader to any desired position, including a maximum height position, a dig position, and a return to travel position.

Other objects of the invention and features of novelty will be apparent from the following description taken in connection with the accompanying drawings.

SUMMARY OF THE INVENTION

The present objects are accomplished in the invention by a system that contains proximity switches that are electronically connected to a valve that controls the raising and lowering of lift arms pivotally attached to a tractor and supporting a bucket at their ends opposite their pivot ends. The machine operator moves a control valve float spool by means of an operator's lever to a detent position, and an electromagnet holds the valve spool in that position by means of a connection of the electromagnet to the proximity switches mounted on the tractor. As the lift arms move up or down and reach a predetermined position, a proximity switch is activated so that it releases the detent magnet, thereby stopping the upward or downward movement of the lift arms. By adjustably positioning targets on the lift arms, one target controlling the uppermost position of the lift arm and another controlling a return to travel position, the proximity switches will respectively stop the lift arms at a predetermined position so that the lift arms will hold the bucket at a preselected maximum height and stop the lift arms at a predetermined position whereat the bucket will be at a height close to a digging position, but high enough above the ground so that the vehicle can travel without scraping the bucket on the ground.

BRIEF DESCRIPTION OF THE DRAWINGS

FIG. 5 is an exploded orthogonal view of proximity switches, along with their brackets and cover, as another aspect of the present invention.

FIG. 6 is a view of the mounting plate of FIG. 4 in relation to other parts of the tractor, including the lift arm in a general horizontal orientation.

FIG. 7 is another view of the mounting plate of FIG. 4 in relation to other parts of the tractor with the lift arm in raised position.

FIG. 8 is yet another view of the mounting plate of FIG. 4 in relation to other parts of the tractor with the lift arm in a lowered, return to travel position.

DETAILED DESCRIPTION OF THE PREFERRED EMBODIMENT

Figure 1:
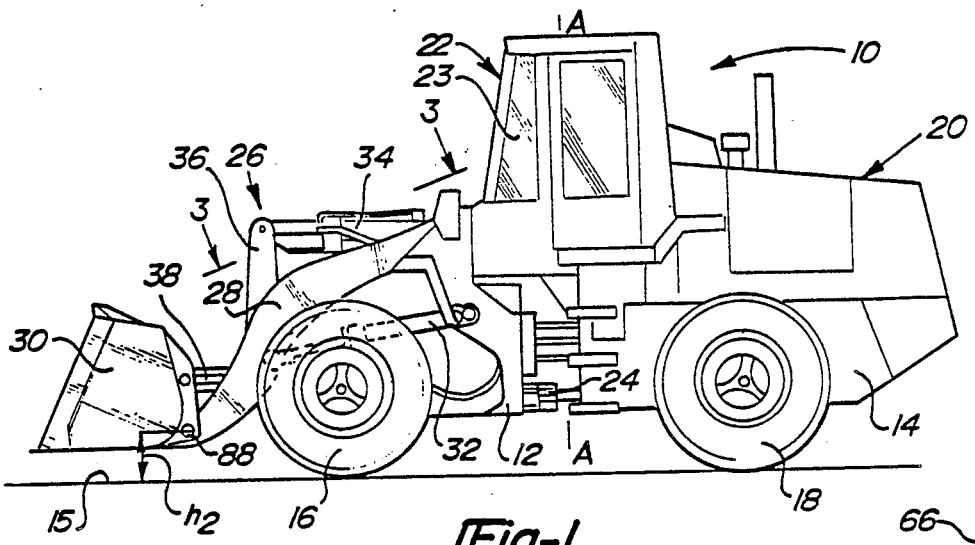
FIG. 1 is a side elevational view of an articulated tractor on which the present invention is installed, with the lift arm and bucket in a travel position.

A material-handling vehicle, for example a tractor, is shown generally at 10 in FIG. 1. While the present invention is adaptive to a conventional front or rear steering tractor, the tractor used in the example of the preferred embodiment is an articulated tractor 10 which has, as typical, articulable frame portions 12 and 14. The frame portions 12 and 14 are pivotally connected to articulate about a vertical axis A—A. For supporting the tractor 10 on the ground 15, front frame portion 12 has an axle with front wheels 16 mounted thereon, and rear frame portion 14 has an axle with rear wheels 18 mounted thereon. In a preferred embodiment, the tractor 10 is a four-wheel drive vehicle with power supplied to each wheel from the tractor's engine or engines housed in an engine section 20 supported by rear frame portion 14.

Front frame portion 12 supports an operator's section 22. Levers housed in operator's section 22 at an operator's station 23 control steering of tractor 10. Articulated steering of tractor 10 is accomplished by a pair of double-acting actuators 24 (only one of which is shown in the drawings) connected between the frame portions 12 and 14 in a typical manner, with each of the actuators 24 being pivotally mounted to the frame portions 12 and 14 on separate sides of the articulation pivot axis A—A.

Also supported by the front frame is a loader assembly 26. Loader 26 has a pair of lift arms 28 pivotally mounted on front frame 12 to support a work implement, here a bucket 30. Lift arms 28 are raised and lowered by means of extensible hydraulic actuators 32 (see FIG. 2) controlled by a predetermined program selected by the operator. This predetermined program is an aspect of the present invention. As lift arms 28 are raised and lowered, the attitude of the bucket 30 relative to the ground level is controlled through actuation of extensible actuator 34, according to another control or predetermined program. Extension and retraction of actuator 34 operates conventional rocker arm 36 and control link 38 to pivot bucket 30.

Figure 2:
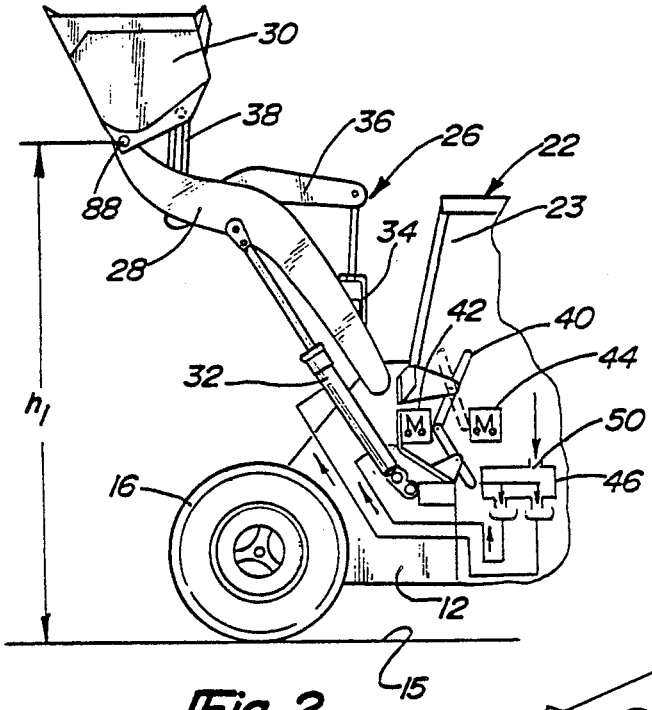
FIG. 2 is a partial side elevational view of the tractor shown in FIG. 1 with the lift arm and bucket in a maximum height position for unloading.

Referring now in particular to FIG. 2, lift arms 28 may automatically be raised or lowered by the operation of a control implement, here control lever 40 shown in schematic but typically found in the operator's section 22. Electromagnets 42 and 44 at opposite ends of the stroke of control lever 40 will hold control lever 40 in either position for raising lift arms 28 or lowering lift arms 28. When lever 40 is held at the end of its stroke by electromagnet 42, an actuator valve 46, having a movable spool 48 and a working fluid supplied through a port 50, supplies the working fluid to the bottom side chamber of actuator 32. Lift arms 28 continue to raise until the piston of actuator 32 is at the end of its stroke, or until the operator overrides the magnet 42 to release the lever 40.

When lever 40 is held at the ends of its stroke by magnet 44, actuator 46 supplies fluid to the top side of actuator 32, and the lift arms are lowered until the piston of actuator 32 is fully inserted therein, that is, until the piston of actuator 32 bottoms out, or until the operator overrides the system. When lever 40 is neither held by magnet 42 or 44, that is, control lever 40 is in a neutral or "float" position, lift arms 28 are at rest.

Figure 3:
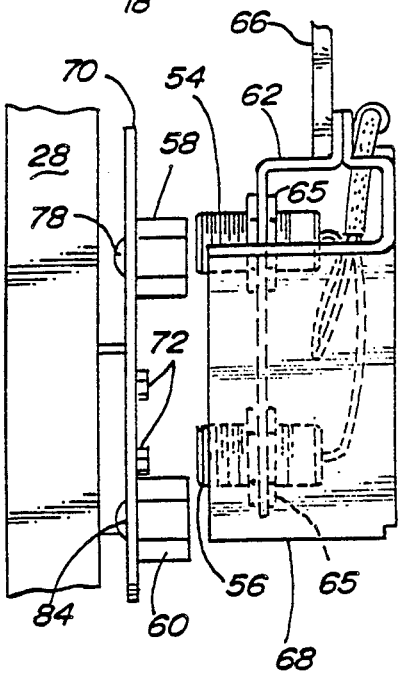
FIG. 3 is a cross-sectional view taken along line 3—3 of FIG. 1 in the direction of the arrows.
Figure 4:
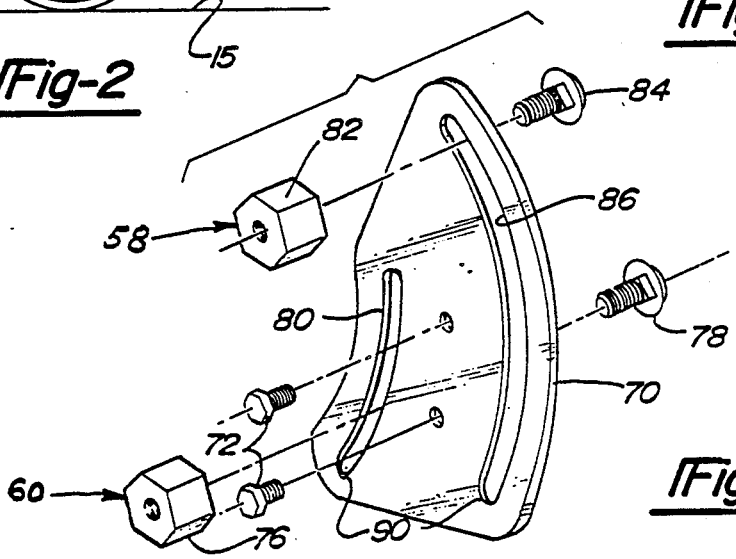
FIG. 4 is an exploded orthographical view of a mounting plate for targets for proximity switches as an aspect of the present invention.

Referring now to FIGS. 3, 4 and 5, a lift arm position control system is shown (see also FIGS. 1 and 2). The position control system designed to release the control lever 40 at a preselected position automatically, that is, without operator intervention. Proximity switches 54 and 56, shown in FIGS. 3 and 5, sense moving targets 58 and 60, also shown in FIG. 4. Proximity switches 54 and 56 are mounted in a bracket 62, through holes 64 thereof shown in FIG. 5, proximity switches 54 and 56 being held into position by jam nuts 65 which are shown in FIG. 5 as a part of each proximity switch 54 and 56 assembly. From the perspective of an observer of tractor 10 who is seated in station 23 and looking forward, bracket 62 is mounted on a left wall 66 of the chassis of tractor 10 and secured there by conventional threaded means and nut assembly 69. In the preferred embodiment shown in FIG. 5, the threaded means are integral with bracket 62. A protective cover 68 is mounted over proximity switches 54 and 56 and bracket 62.

On wall 66, proximity switches 54 and 56 are located adjacent lift arm 28. Mounted on lift arm 28 is a mounting plate 70 mounting targets 58 and 60. Mounting plate 70 is secured to lift arm 28 by threaded bolts 72 so that the mounting plate does not move relative to lift arm 28, but rather moves with lift arm 28. More specifically, as shown in FIG. 3, bolts 72 are received through plate 70 which is fixedly secured to lift arm 28.

As can be seen more particularly in FIG. 4, target 60 is comprised of a nut 76 and bolt 78 arrangement, whereby bolt 78 is received through arcuate slot 80 and into nut 76. Similarly, target 58 comprises a nut 82 and bolt 84 arrangement, whereby bolt 84 is received through an arcuate slot 86 and into nut 82. Slot 86 extends in its arcuate path a greater length than slot 80.

An adjustment procedure is used to properly locate proximity switches 54 and 56 and corresponding targets 58 and 60. It should first be appreciated that when proximity switch 56 is to be used for maximum height control corresponding moving target 60 is also used for height control. Similarly, proximity switch 54 is to be used for return to travel control with a corresponding target 58. A first adjustment is made to avoid damage to the proximity switches 54 and 56 by adjusting the proximity switches 54 and 56 back into bracket 62 so that this assembly will clear everything on the lift arm, including mounting plate 70 and targets 58 and 60, as the lift arm 28 sweeps past the assembly that includes proximity switches 54 and 56. The lift arms 28 are then raised to approximately a horizontal position as shown in FIG. 6. In this position, targets 58 and 60 are to be temporarily located on mounting plate 70, within slots 80 and 86. Target 58 is accordingly located within slot 86, and nut 82 is tightened upon bolt 84 so as to secure location of target 58 on mounting plate 70. By the same procedure, target 60 is located within slot 80, and nut 76 is tightened upon bolt 78 to secure this position for target 60. The proximity switches 54 and 56 can be adjusted outwardly toward targets 58 and 60 respectively by means of the jam nuts 65 shown in the proximity switch assemblies of FIG. 5, until an air gap from approximately ⅛" to 3/16" (approximately 3.5 mm to 5.0 mm) is obtained. The adjustment having been made, the proximity switches 54 and 56 are to be locked in position with their jam nuts 65.

Still continuing the adjustment procedure, a setting may be obtained for the height control target 60 that will locate the hinge pin 88 of bucket 30 at a height h1 above ground 15. Preferably, height h1 would be approximately 130 inches above the ground 15. For h1 to be about 130 inches above ground 15, which represents an uppermost position for lift arms 28, height control target 60 should have its center adjusted to 1.7" (43 mm) above the bottom 90 of slot 80, as plate 70 is oriented in FIG. 4. Target 60 in this position will stop the rising lift arms 28 approximately 10 degrees below their full height angle of 43 degrees. This will locate the bucket hinge pin 88 a height h1 above the ground 15.

For setting of the return to travel target 58 that will locate the hinge pin 88 of bucket 30 at height h2 shown in FIG. 1, which is preferably about 16" above the ground 15, the center of return to travel target 58 is to be positioned approximately 5.25" (133 mm) above the bottom 90 of slot 86 as plate 70 is oriented in FIG. 4. The 16" or h2 height does not necessarily represent the lowermost position of lift arms 28, as the operator may control lowering of lift arms 28 to a position below the return to travel position by overriding the system, for example by holding the lever 40 in a position to continue lowering of the lift arms 28.

Location of targets 58 and 60 will determine where the lift arms 28 will automatically stop while moving either up or down. The height control proximity switch 56 and target 60 control the stopping position shown in FIG. 7 of the lift arms as they are raised. The return to travel proximity switch 54 and its target 58 control the stopping position shown in FIG. 8 of the lift arms 28 as they are lowered.

Finally, in the adjustment procedure, all switches and targets must be made tightly secured in their positions. Two test procedures may be used to determine if the lift arms 28 are functioning properly. One means is to check the system by operating the lift arm, putting control lever 40 in the raise or lower positions, whereby control lever 40 is retained by electromagnet 42 or 44, respectively, with reference to FIG. 2. The system may also be checked without operating the lift arms 28 by turning on the ignition switch of tractor 24 without starting the engine, putting the control lever in either the raise or lower position, and passing a piece of steel across the proper proximity switch 54 or 56 within the air gap of ⅛" to 3/16". The control lever 40 should be released and returned to neutral.

Thus, it is apparent that there is provided in accordance with the present invention a return to travel means that fully satisfies the objects, aims, and advantages set forth herein. But while the invention has been described in conjunction with specific embodiments, it is evident that many alternatives, modifications, and variations will be apparent to those in the art in light of the foregoing description. Accordingly, the invention is intended to embrace all alternatives, modifications, and variations as fall within the spirit and scope of the appended claims.

We claim:

1. A material loading vehicle supported by a ground surface and a return to travel assembly in a combination comprising:

a material loading vehicle chassis;

a work implement;

at least one lift arm supported by said chassis to pivot between a discrete uppermost position and a discrete lowermost work position, said lift arm supporting said work implement;

actuating means for pivotally raising said lift arm to said uppermost position and pivotally lowering said lift arm to said lowermost position;

first control means operatively connected to said actuating means for controlling raising said lift arm and lowering said lift arm; and second control means operatively connected to said first control means for automatically stopping said lift arm at a discrete position intermediate said uppermost position and said lowermost position, the intermediate position being a return to travel position at which the lift arm supports said work implement safely above said ground surface for said vehicle to travel thereon without generally scraping said implement upon the ground surface and whereat said implement can be quickly lowered to said lowermost work position;

said second control means includes a first position sensor for sensing said lift arm when said lift arm is in said return to travel position and said second control means includes a first interrupt means for interupting the pivotal raising and lowering of said lift arm by said actuating means when said first position sensor senses said lift arm in said return to travel position, said second control means includes adjustment means and said return to travel position is selected from a continuous range of intermediate positions by adjusting said adjustment means, and said second control means also automatically stops said lift arm at an uppermost position selected from a continuous range of uppermost positions by adjusting said adjustment means;

the second control means includes a second position sensor for sensing said lift arm when said lift arm is in said uppermost position and said second control means includes a second interrupt means for interrupting the pivotal raising and lowering of said lift arm by said actuating means when said second position sensor senses said lift arm in said uppermost position;

said first and second position sensors sense respective first and second targets mounted upon said lift arm, said first and second position sensors are proximity switches; and said first and second position sensors are supported by said chassis and fixedly located with respect thereto; and said adjustment means includes said targets mounted upon said lift arm and on which said targets may be adjustably located to change the return to travel and uppermost positions.

2. The combination of claim 1, in which said targets mounted upon said lift arm are mounted on a plate fixedly attached to said lift arm, said plate having at least one arcuate slot therethrough and in which at least one target is a nut and bolt assembly, said bolt extending through said at least one slot and said nut receiving said bolt to tighten down upon said bolt and upon said plate so as to adjustably fix said nut and bolt on said plate, whereby said at least one target is sensed by at least one of said proximity switch when said lift arm is in a predetermined position.

3. The combination of claim 2, in which the at least one slot is two slots, one slot being radially more proximate to the pivot axis of said lift arm than the other slot and said one slot extending in a shorter arcuate path than said other slot.

4. The combination of claim 3, in which each of said first and second targets are mounted in a respective one of said two slots, said first target being mounted in said slot more radially proximate to said pivot axis and being sensed by said first proximity switch when said lift arm is in said uppermost position and said second target being mounted in said other slot and being sensed by said second proximity switch when said lift arm is in said return to travel position.

5. The combination of claim 4, in which the first control means includes a control lever pivotal in a first direction to a first end of stroke position and pivotal in a second direction to a second end of stroke position, said control lever, when in said first end of stroke position, controlling actuation of said actuating means to raise said lift arm and, when in said second end of stroke position, controlling actuation of said actuating means to lower said lift arm, and said first control means including first retention means for releasably retaining said lever at said first end of stroke position and second retention means for releasably retaining said lever at said second end of stroke position, said lever returning to a neutral position when not retained by one of said first and second retention means, said actuating means being inoperative when said control means is in a neutral position, and said lift arm stopping when said control means is in said neutral position.

6. The combination of claim 5, wherein each one of said interrupt means includes an operative connection between one of said retention means and a corresponding one of said position sensors, said operative connector transducing sensing by said corresponding sensor to releasing said control lever by said one retention means, so as to cause said lever to return to a neutral position.

7. The combination of claim 6, said actuating means including a hydraulic actuator bridging between said chassis and said lift arm to pivotally raise said lift arm when said actuator extends and to pivotally lower said lift arm when said actuator retracts.

8. The combination of claim 7, wherein said work implement is a bucket.

9. A position control system for a material loading vehicle supported by a ground surface, said material loading vehicle having a material loading vehicle chassis, a work implement, and at least one lift arm for supporting said work implement, said lift arm supported by said chassis to pivot between a discrete uppermost position and a discrete lowermost position as an actuator bridging between said lift arm and said chassis extends to pivot said lift arm to the uppermost position and retracts to lower said lift arm to the lowermost position, said actuator being controlled by a control implement, the lift arm position control system comprising:

means operatively connected to said control implement for automatically stopping said lift arm at a discrete return to travel position, said return to travel position being intermediate said uppermost position and said lowermost position and being a position at which the lift arm supports said work implement safely above said ground surface for said vehicle to travel thereon without generally scraping said implement upon the ground surface;

wherein said means for automatically stopping said lift arm in said return to travel position includes a proximity sensor fixedly attached to said chassis, a target fixedly attached to said lift arm, said sensor capable of sensing said target when said lift arm is in a return to travel position, and a means for transducing the sensing of said target by said proximity sensor to an automatically stopping of said actuator by said control implement; and a second proximity switch fixedly attached to said chassis and a second target fixedly attached to said lift arm, said second proximity switch sensing said second target when said lift arm is in said uppermost position, and means for transducing sensing by said second proximity sensor to stop said actuator by said control implement.

10. A position control system for lift arms on a tractor, said lift arms supporting a digging bucket and said lift arms capable of raising and lowering the digging bucket, the position control system comprising:

an operator's lever capable of being positioned in at least three positions including a first detent position, a second detent position, and a float position;

an actuator connected to said lift arm to pivotally raise and lower said lift arm;

an actuator control valve connected to said actuator and to said lever so that when said lever is in said first detent position, said actuator raises said lift arm and when said lever is in said second detent position, said actuator lowers said lift arms, said actuator neither raising nor lowering said lift arm when in a float position;

a first electromagnet for holding said lever in said first detent position;

a second electromagnet for holding said lever in said second detent position;

a first proximity switch electronically connected to said first electromagnet, said first proximity switch sensing at least one of said lift arms when said lever is in said first detent position and said lift arm is raised to a first predetermined position, said electromagnet releasing said lever from said first detent position to said float position; and a second proximity switch electronically connected to said second electromagnet, said second proximity switch sensing said lift arm when said lever is in said second detent position and said lift arm is lowered to a predetermined return to travel position, said second electromagnet releasing said lever to said float position, said digging bucket, when at the return to travel position being adjacent a ground surface beneath the digging bucket without the digging bucket touching the ground surface, and said bucket being movable to a lowermost work position from said return to travel position.

* * * * *